US008510909B2

(12) United States Patent
Spatz et al.

(10) Patent No.: US 8,510,909 B2
(45) Date of Patent: Aug. 20, 2013

(54) ELECTRIC HOUSEHOLD APPLIANCE COMPRISING A BASE FOR THE GENERATION OF STEAM, HAVING A REMOVABLE TANK

(75) Inventors: Dierk Spatz, Erbach (DE); Martin Krebs, Obernburg (DE); Matthias Hahn, Frankfurt (DE)

(73) Assignee: Rowenta Werke GmbH, Offenbach (DE)

( * ) Notice: Subject to any disclaimer, the term of this patent is extended or adjusted under 35 U.S.C. 154(b) by 280 days.

(21) Appl. No.: 12/937,115

(22) PCT Filed: Mar. 16, 2009

(86) PCT No.: PCT/IB2009/000539

§ 371 (c)(1),
(2), (4) Date: Dec. 28, 2010

(87) PCT Pub. No.: WO2009/125263

PCT Pub. Date: Oct. 15, 2009

(65) Prior Publication Data

US 2011/0107546 A1 May 12, 2011

(30) Foreign Application Priority Data

Apr. 9, 2008 (FR) ..... 08 01950

(51) Int. Cl.
*A47L 11/34* (2006.01)

(52) U.S. Cl.
USPC ..... 15/405; 15/320; 15/321; 15/322; 68/222; 134/102.1; 134/102.2; 122/459; 392/399; 392/394

(58) Field of Classification Search
USPC ..... 15/320, 321, 322; 134/102.1, 102.2; 68/5 R, 15, 207, 222; 122/459–479.7; 392/386–387, 390–391, 394, 396–406
See application file for complete search history.

(56) References Cited

U.S. PATENT DOCUMENTS

| | | | | |
|---|---|---|---|---|
| 3,559,427 | A | 2/1971 | Baker | |
| 3,685,182 | A | 8/1972 | Davidson et al. | |
| 2003/0115711 | A1 * | 6/2003 | Rosa et al. | 15/320 |
| 2005/0132761 | A1 * | 6/2005 | Carrubba et al. | 68/222 |
| 2005/0150261 | A1 | 7/2005 | Carlucci | |

* cited by examiner

*Primary Examiner* — Mark Spisich
*Assistant Examiner* — Andrew A Horton
(74) *Attorney, Agent, or Firm* — Browdy and Neimark, PLLC

(57) ABSTRACT

Electrical household appliance comprising a base (1) for the generation of steam, having a liquid tank (6) mounted removably on a receiving socket (10) and having a steam generator located outside of said tank (6), the steam generator being supplied by gravity by a supply line from the tank (6) and having a steam outlet through which the steam can escape towards a work tool, such as a crease-removing brush, said supply line comprising an inlet orifice located on the receiving socket (10), and said tank (6) comprising a closed enclosure (61) having only one outlet orifice (52) which connects the said inlet orifice when the tank is placed on the receiving socket (10), which appliance is characterized in that said tank (6) connects leaktightly onto said receiving socket (10) and in that said appliance has a vent line admitting air to the outlet orifice (52) of the tank, said vent line having one end connected to the exterior which is higher than the outlet orifice (52) of the tank.

20 Claims, 4 Drawing Sheets

ELECTRIC HOUSEHOLD APPLIANCE COMPRISING A BASE FOR THE GENERATION OF STEAM, HAVING A REMOVABLE TANK

The present invention relates to an appliance comprising a base for the production of steam having a tank and a boiling chamber fed by gravity with liquid from the tank and relates more particularly to an electrical household appliance in which the tank is mounted removably on a receiving pedestal of the base.

There is known from U.S. patent application 2005/0132761, a steam ironing appliance comprising a base with a boiling chamber fed by gravity from a water tank removably mounted on a receiving pedestal. In this document, the tank is a closed chamber equipped with an outlet orifice at its bottom, venting of the tank being effectuated by the outlet orifice so that water from the tank flows through the supply circuit of the boiling chamber until the liquid level in the base reaches the level of the outlet orifice.

Such an appliance has the disadvantage of being subject to flows of water during transport, water stagnating in the bottom of the receiving pedestal, around the outlet orifice, have a tendency to flow along the walls of the base during tilting of the appliance or during sudden movements.

Such an appliance also has the disadvantage of allowing a backflow of water at the level of the receiving pedestal when the vapor pressure rises in the boiling chamber, which happens particularly when the steam outlet conduit that is connected the steam brush is bent or kinked so that the steam flow does not take place normally.

Thus, an object of this invention is to provide an apparatus reducing or overcoming these drawbacks.

To this end, the invention has for its object an electrical household appliance comprising a base for the production of steam having a tank for liquid mounted in a removable manner on a receiving pedestal and containing a steam generator disposed outside the tank, the steam generator being fed by gravity through a supply circuit from the tank and having a steam outlet through which steam can escape toward a working tool, such as a steam brush, the supply circuit having an inlet orifice disposed on the receiving pedestal, the tank comprising an enclosure with only one outlet orifice in communication with the inlet orifice when the tank is placed on the receiving pedestal, wherein the tank is coupled in a sealed manner on the receiving pedestal and in that the appliance includes a venting circuit for conducting air to the level of the outlet orifice of the tank, the venting circuit having one end in communication with the outside which is elevated relative to the outlet orifice of the tank.

According to another feature of the invention, the volume of liquid that can be contained in the venting circuit between the outlet orifice of the tank and the end in communication with the outside is greater than the volume of liquid contained in the steam generator and in the supply circuit under normal operating conditions of the appliance.

By volume of water contained in the steam generator and the supply circuit under normal operating conditions, is meant the volume of water contained in these organs when the water level is stabilized, i.e. when it reaches the level of the outlet orifice of the tank.

According to another feature of the invention, the venting circuit comprises a local buffer zone at the level of which the passage cross section is larger.

According to another feature of the invention, the volume of the buffer zone is greater than the volume of liquid in the supply circuit and in the steam generator under normal operating conditions of the appliance.

According to yet another feature of the invention, the appliance includes a collecting dish placed beneath the inlet orifice of the receiving pedestal, this collecting dish having a bottom presenting a discharge orifice leading to the steam generator and having a peripheral wall having a venting orifice.

According to another feature of the invention, the buffer zone of the venting circuit is integrated in the collecting dish.

According to yet another feature of the invention, the collecting dish has a deflector extending between the discharge orifice and the venting orifice.

According to another feature of the invention, the outlet orifice of the tank is equipped with a closing valve that is opened automatically when setting up the tank on the base by an element placed at the bottom of the receiving pedestal.

According to another feature of the invention, the receiving pedestal has a cavity at the bottom of which is disposed said inlet orifice.

According to another feature of the invention, the sealing of the connection between the tank and the receiving pedestal is made by means of a lip seal carried by the receiving pedestal on which the tank rests.

According to another feature of the invention, the base has at least two wheels and a transport handle.

One will better understand the objects, aspects and advantages of the present invention, from the description given below of a particular embodiment of the invention presented by way of non-limiting example, with reference to the accompanying drawings in which.

Only items necessary for the understanding of the invention have been shown. To facilitate the reading of the drawings, the same elements bear the same references from one figure to another.

Figure 1:
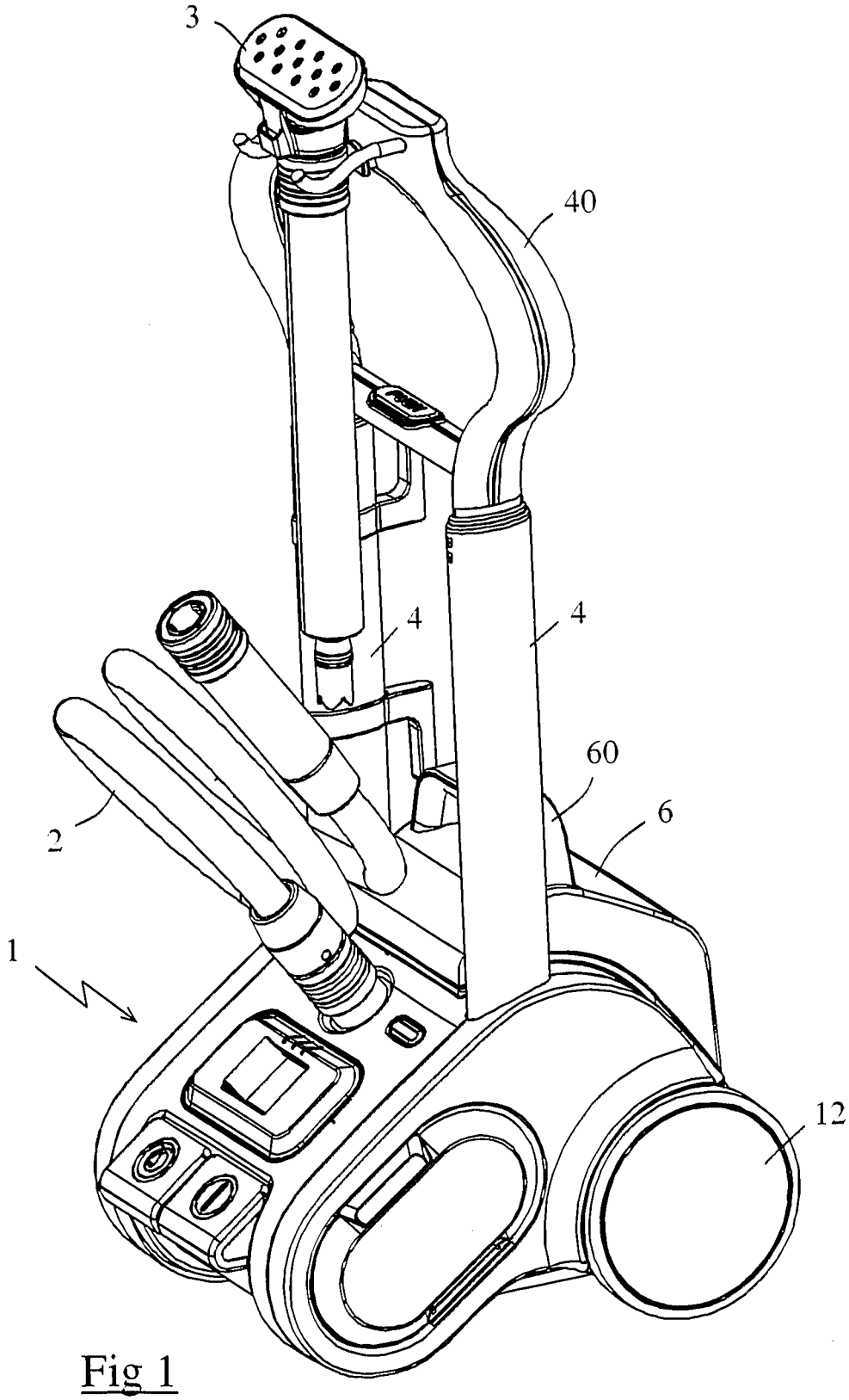
FIG. 1 is a perspective view of an ironing appliance according to a particular embodiment of the invention.

FIG. 1 shows a steam ironing appliance comprising a base 1 for steam generation to be connected by a hose 2 to an accessory, such as a steam brush 3.

This appliance is advantageously provided with two telescopic posts, or tubes, 4 supporting a handle 40 in the form of a coat hanger, shown only in FIG. 1, allowing the support of a garment.

The base 1 has two wheels 12 disposed at the rear end of base 1 to allow easy movement of the appliance by grasping the handle and tilting the base back so that only the wheels 12 remain in contact with the ground.

The base 1 also includes a removable tank 6 located above the axis of both wheels 12, the tank 6 having a handle 60 at its upper end to facilitate its removal from the base 1.

Figure 2:
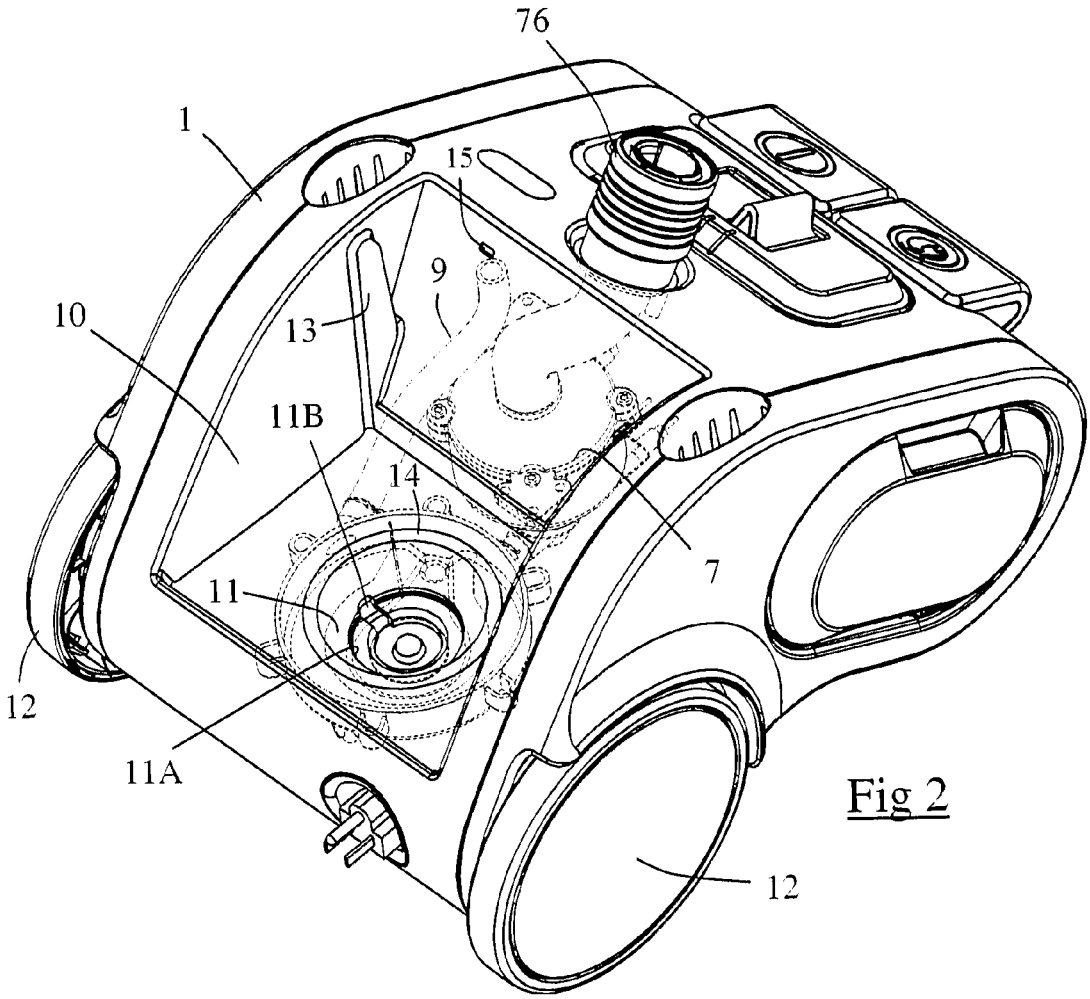
FIG. 2 is a perspective view of the base of the appliance of FIG. 1, stripped of the tank, its portico and the steam cord.
Figure 3:
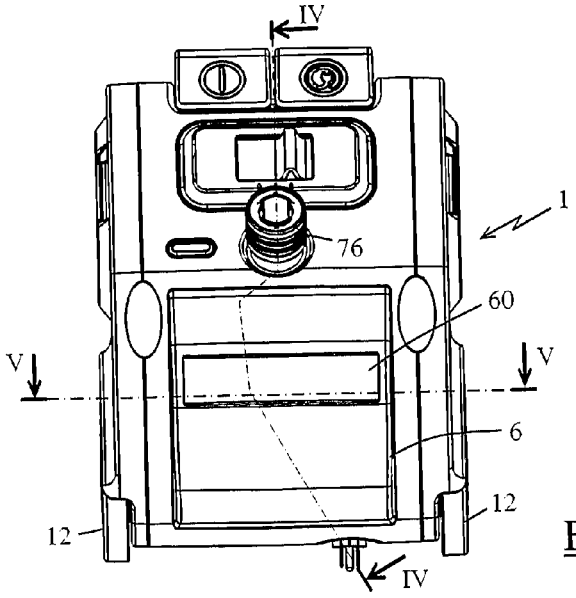
FIG. 3 is a top view of the apparatus of FIG. 1, stripped of its portico and steam cord.

According to FIG. 2, which shows the base 1 without the tank 6, the base 1 comprises a receiving pedestal 10 for the tank 6 comprising a cavity 11 having a circular central orifice 11A and a lateral cutout 11B forming an inlet connected to a supply circuit for a steam generator 7, shown in dotted lines in this figure.

Figure 4:
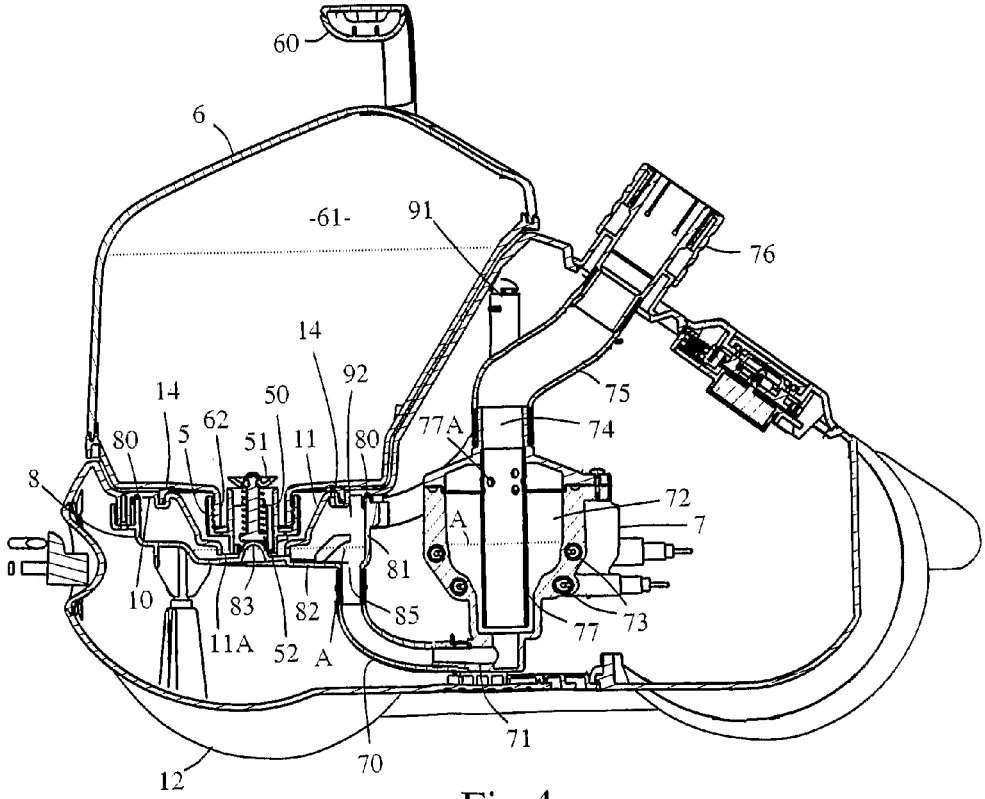
FIG. 4 is a sectional view along line IV-IV of FIG. 3—
Figure 5:
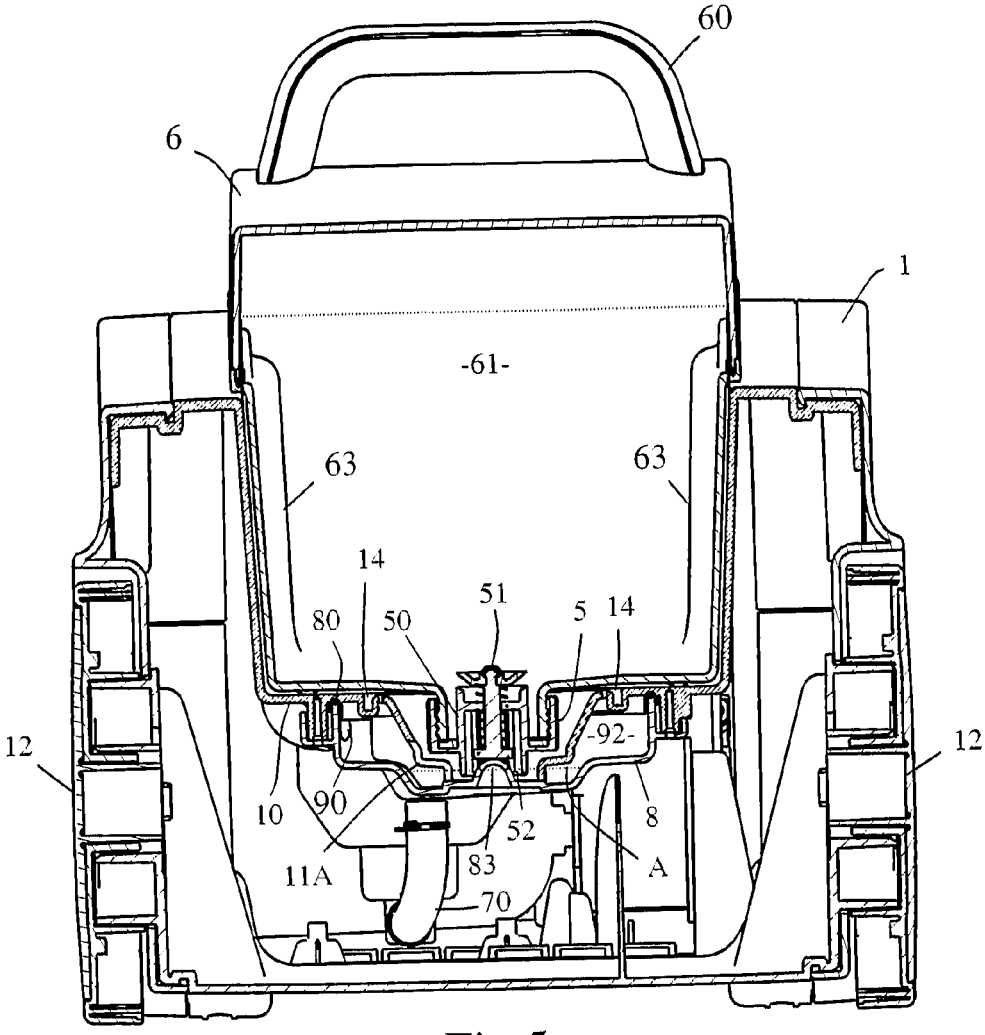
FIG. 5 is an enlarged cross-sectional view taken along line VV of FIG. 3.
Figure 6:
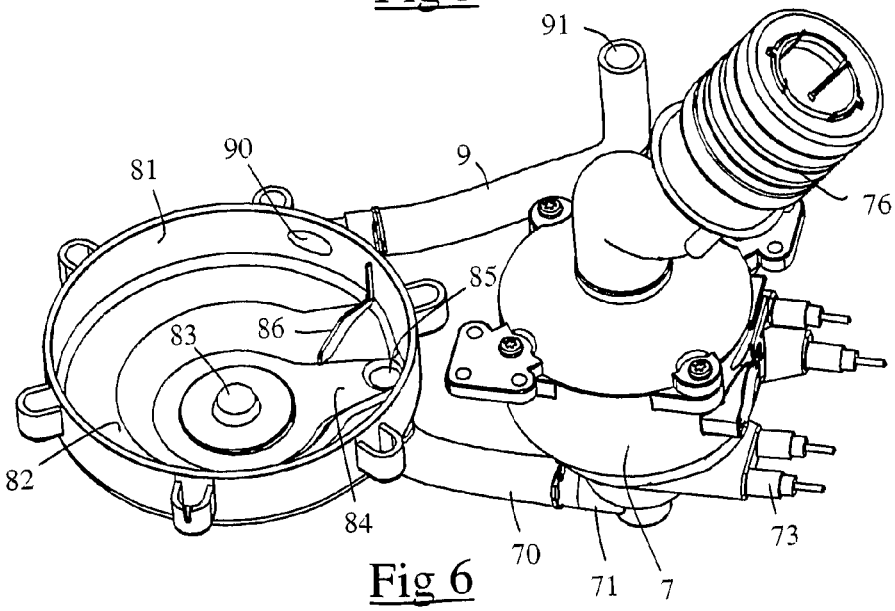
FIG. 6 is a perspective view of the supply circuit for the boiling chamber of the appliance of FIG. 1.

As can be seen in FIGS. 4-6, the supply circuit has a collecting dish 8 positioned directly below the receiving pedestal 10, the dish 8 having an upper edge receiving a seal 80 coming into contact with the receiving pedestal 10 to form a sealed connection therewith.

Collecting dish 8 has a substantially cylindrical peripheral wall 81 and a bottom 82 comprising a depressed central portion at the middle of which a boss 83 protrudes, this boss 83 coming to engage in the center orifice 11A of the cavity 11 of receiving pedestal 10.

The depressed portion also has a channel 84, shown in FIG. 6, extending to the peripheral wall 81 of the dish 8, this channel 84 being inclined towards a discharge orifice 85 disposed at the peripheral edge of bottom 82 of the dish. This discharge orifice 85 is connected by a supply conduit 70 to an inlet connector 71 disposed at the lower end of the steam generator 7.

According to FIG. 4, the inlet connector 71 communicates with a boiling chamber 72 defined by an aluminum body in which are embedded heating elements 73 whose electric supply is controlled by a circuit not shown in the figures.

The steam generator includes a steam outlet orifice 74 at its upper end which is connected by a tube 75 to a connector 76 disposed outside of the base 1 and provided to enable connection with the cord 2.

Preferably, the boiling chamber 72 contains a tube 77 extending from the outlet orifice 74 disposed at the upper end of the generator 7, to near the lower end of the boiling chamber 72, this tube 77 forming a separation limiting the heat exchange between the water present outside of the tube 77 and the water present inside the tube 77. Such a tube 77 has the advantage of allowing a faster increase in temperature of water placed outside the tube 77 at the start of operation of the appliance and thus reducing the time required for the production of steam. The upper part of tube 77 has openings 77A permitting transfer of the steam produced to outside the tube toward steam outlet orifice 74, these openings 77A being placed at a height such that they are above the level A of stabilization of water in the boiling chamber 72 when the supply circuit is supplied with water from the tank 6.

According to FIGS. 4 and 5, the tank 6 has a closed enclosure 61 having a single opening 62 disposed at the lower end of the tank 6, the opening 62 receiving a stopper 5 provided with an evacuation conduit 50 closed by a valve 51, the lower end of conduit 50 having an outlet orifice 52 through which water can flow from the tank 6 when the valve 51 is open. Advantageously, the stopper 5 is fixed by screwing on the opening 62 so as to be removable to facilitate the operation of filling the tank 6, the tank then being held with the handle 60 downwards.

The tank 6 thus produced can be transported by the handle 60 without risk of water flow through the orifice 52, valve 51 ensuring a tight closure of the conduit 50 when the tank 6 is disposed on the receiving pedestal 10.

Conversely, when the tank 6 is placed on the receiving pedestal 10, the stopper 5 for closing the tank 6 is engaged in the cavity 11 and projection 83, protruding from the bottom of the collecting dish 8, comes to move the valve 51, against a restoring spring, toward an open position allowing passage of water from the tank 6 towards the dish 8. To aid correct positioning of the tank 6 on the receiving pedestal 10 during this operation, the receiving pedestal 10 advantageously has side walls comprising guide ribs 13 cooperating with grooves 63 of the tank and imposing a vertical translation movement during removal or installation of the tank 6.

More particularly according to the invention, the tank 6 is coupled in a sealed manner to the receiving pedestal 10 so as to prevent any backflow of water from the supply circuit outside the base 1. This sealing of the connection between the tank 6 and the receiving pedestal 10 is advantageously made by means of a lip seal 14 extending to the periphery of the cavity 11 and coming to bear against the bottom of the tank 6.

To allow the flow of water from tank 6 toward collecting dish 8, a venting circuit is provided at the level of dish 8.

According to FIG. 6, this venting circuit includes a pipe 9 assuring exposure of the dish 8 to the air, which opens at the peripheral wall 81 of the dish at the level of a venting orifice 90, this tube 9 having one end 91 in communication with the outside, ensuring that the air is in communication with the circuit, which opens into the upper part of the base 1 at the level of an opening 15 placed on a side wall of the receiving pedestal 10 disposed in front of the tank 6.

This venting circuit ensures that the dish 8 is put in communication with the air and allows water from the tank 6 to flow into the supply circuit of the generator 7, the volume of water flow through the outlet orifice 52 of the tank being replaced by air entering the tank 6 through the outlet orifice 52 until the water level in the dish 8 reaches the lower end of conduit 50 for evacuating the tank, thus preventing all ingress of air into the tank 6 and thus the further flow of water out of the tank 6. The water level is then stabilized in the generator at a level A shown in dotted lines in FIG. 4, equivalent to that in the dish 8 so that the bottom of the boiling chamber 72, where the heating elements 73 is present, is immersed and the upper part of the chamber 72 including the openings 77A to transfer the steam is emerged.

Such a venting circuit allows perfect operation of the appliance. It also permits the appliance to be transported in an inclined position without risk of flow of water out of the base. In effect, during inclination of the base 1, for example for transportation on wheels 12, the water in the collecting dish 8 cannot escape through the receiving pedestal 10 due to the presence of the sealing ring 14 at the junction between the tank 6 and the receiving pedestal 10, nor by the venting circuit which has an end 91 communicating with the air located at a raised height on the front of the base 1.

Advantageously, the venting circuit is dimensioned so that the volume of gas or liquid that the venting circuit may contain between the outlet orifice 52 of the tank and the end in communication with the outside air is greater than the volume of water contained in the boiling chamber 72 and in the supply circuit of the latter when the water level is stabilized at the height of outlet orifice 52.

This characteristic permits limiting of the amount of water leaking through the end of the venting circuit in communication with the outside, when due to some accident, the steam produced by the steam generator can not escape normally through the steam outlet orifice. Such a situation can occur for example when the cord for carrying steam to the steam brush is pinched or folded so that its passage cross section is greatly reduced. In such a case, the increase in pressure in the boiling chamber causes a backflow of water in the generator and in the supply circuit in the venting circuit until the steam can escape through the end of the venting circuit.

Preferably, the dish 8 comprises a header buffer zone 92 extending above the dotted line A, corresponding to the stabilization level of water in the normal operation of the appliance, the volume of which is greater than the volume of water contained in the boiling chamber 72 and in the supply circuit of the latter so that buffer zone 92 may receive all of the water that can be made to flow back toward the venting circuit. This buffer zone 92 prevents any backflow of water through the venting pipe 9 upon a pressure rise in the boiling chamber 72, steam escaping from the generator 7 repelling water in the buffer zone 92 and then escaping through the venting orifice.

According to FIG. 6, the collecting dish 8 also has a deflector 86 constituted by a wall extending radially at the bottom of the dish 8 and against the peripheral wall 81. This deflector 86 is disposed in the area extending between the discharge orifice 85 and the venting orifice 90 so that when water is caused to flow back through the discharge orifice 85, the latter is deflected toward the center of the dish 8 and is not sent in the direction of the venting orifice 90.

Of course, the invention is not limited to the embodiment described and illustrated which has been given as an example. Modifications remain possible, particularly in terms of the constitution of the various elements or by substitution of technical equivalents, without departing from the scope of protection of the invention.

Thus, in one embodiment not shown, the venting circuit may be carried by the tank instead of being carried by the base of the appliance. This venting circuit could for example be constituted by a pipe extending within the tank from an opening at the top of the tank to the lower end of the evacuation conduit of the tank. This pipe can also advantageously include a buffer zone constituted by an area presenting a passage cross section of larger diameter than that of the pipe, dimensioned to accommodate all of the water that can be discharged by the boiling chamber.

The invention claimed is:

1. An electrical household appliance comprising a base (1) for the production of steam having a tank (6) for liquid mounted in a removable manner on a receiving pedestal (10) and containing a steam generator (7) disposed outside said tank (6), the steam generator (7) being fed liquid by gravity through a supply circuit from the tank (6) and having a steam outlet (74) through which steam can escape toward a working tool (3), such as a steam brush, said supply circuit having an inlet orifice (11B) disposed on the receiving pedestal (10), said tank (6) comprising an enclosure (61) with only one outlet orifice (52) in communication with said inlet orifice (11B) when the tank is placed on the receiving pedestal (10), wherein said appliance further comprises a seal coupling said tank (6) in a sealed manner on said receiving pedestal (10) to prevent any backflow of water from the supply circuit outside of the base, and said appliance includes a venting circuit for conducting air to the level of the outlet orifice (52) of the tank, said venting circuit having one end (91) in communication with air outside of said electrical household appliance and said one end being elevated relative to the outlet orifice (52) of the tank.

2. An electrical household appliance according to claim 1, wherein said venting circuit comprises a local buffer zone (92) at the level of which the passage cross section is larger.

3. An electrical household appliance according to claim 2, wherein the volume of said buffer zone (92) is greater than the volume of liquid in the supply circuit and in the steam generator (7) under normal operating conditions of the appliance.

4. An electrical household appliance according to claim 1, wherein it includes a collecting dish (8) placed beneath the inlet orifice (11A, 11B) of the receiving pedestal (10), said collecting dish (8) having a bottom presenting a discharge orifice (85) leading to the steam generator (7) and having a peripheral wall (81) having a venting orifice (90).

5. An electrical household appliance according to claim 1, wherein the outlet orifice of the tank is equipped with a closing valve (51) that is opened automatically when setting up the tank (6) on the base (1) by an element (83) placed at the bottom of the receiving pedestal (10).

6. An electrical household appliance according to claim 5, wherein said receiving pedestal (10) has a cavity (11) at the bottom of which is disposed said inlet orifice (11A, 11B).

7. An electrical household appliance according to claim 1, wherein said seal coupling said tank (6) on said receiving pedestal (10) is a lip seal (14) carried by said receiving pedestal (10) on which said tank (6) rests.

8. An electrical household appliance comprising a base (1) for the production of steam having a tank (6) for liquid mounted in a removable manner on a receiving pedestal (10) and containing a steam generator (7) disposed outside said tank (6), the steam generator (7) being fed by liquid gravity through a supply circuit from the tank (6) and having a steam outlet (74) through which steam can escape toward a working tool (3), such as a steam brush, said supply circuit having an inlet orifice (11B) disposed on the receiving pedestal (10), said tank (6) comprising an enclosure (61) with only one outlet orifice (52) in communication with said inlet orifice (11B) when the tank is placed on the receiving pedestal (10), wherein said tank (6) is coupled in a sealed manner on said receiving pedestal (10) and said appliance includes a venting circuit for conducting air to the level of the outlet orifice (52) of the tank, said venting circuit having one end (91) in communication with air outside of said electrical household appliance which is elevated relative to the outlet orifice (52) of the tank, wherein the volume of liquid that can be contained in the venting circuit between the outlet orifice (52) of the tank and the end (91) in communication with the outside is greater than the volume of liquid contained in the steam generator (7) and in the supply circuit under normal operating conditions of the appliance.

9. An electrical household appliance according to claim 8, wherein said venting circuit comprises a local buffer zone (92) at the level of which the passage cross section is larger.

10. An electrical household appliance according to claim 9, wherein the volume of said buffer zone (92) is greater than the volume of liquid in the supply circuit and in the steam generator (7) under normal operating conditions of the appliance.

11. An electrical household appliance according to claim 10, wherein it includes a collecting dish (8) placed beneath the inlet orifice (11A, 11B) of the receiving pedestal (10), said collecting dish (8) having a bottom presenting a discharge orifice (85) leading to the steam generator (7) and having a peripheral wall (81) having a venting orifice (90).

12. An electrical household appliance according to claim 11, wherein said collecting dish (8) has a deflector (86) extending between the discharge orifice (85) and the venting orifice (90).

13. An electrical household appliance according to claim 10, wherein said buffer zone (92) of the venting circuit is integrated in a collecting dish (8).

14. An electrical household appliance according to claim 13, wherein said collecting dish (8) has a deflector (86) extending between a discharge orifice (85) and a venting orifice (90).

15. An electrical household appliance according to claim 14, wherein the outlet orifice of the tank is equipped with a closing valve (51) that is opened automatically when setting up the tank (6) on the base (1) by an element (83) placed at the bottom of the receiving pedestal (10).

16. An electrical household appliance according to claim 15, wherein said receiving pedestal (10) has a cavity (11) at the bottom of which is disposed said inlet orifice (11A, 11B).

17. An electrical household appliance according to claim 16, wherein the sealing of the connection between the tank (6) and the receiving pedestal (10) is made by means of a lip seal (14) carried by the receiving pedestal (10) on which the tank (6) rests.

18. An electrical household appliance according to claim 17, wherein the base (1) has at least two wheels (12).

19. An electrical household appliance according to claim 8, wherein the sealing of the connection between the tank (6) and the receiving pedestal (10) is made by means of a lip seal (14) carried by the receiving pedestal (10) on which the tank (6) rests.

20. An electrical household appliance comprising a base (1) for the production of steam having a tank (6) for liquid mounted in a removable manner on a receiving pedestal (10) and containing a steam generator (7) disposed outside said tank (6), the steam generator (7) being fed by liquid gravity through a supply circuit from the tank (6) and having a steam outlet (74) through which steam can escape toward a working tool (3), such as a steam brush, said supply circuit having an inlet orifice (11B) disposed on the receiving pedestal (10), said tank (6) comprising an enclosure (61) with only one outlet orifice (52) in communication with said inlet orifice (11B) when the tank is placed on the receiving pedestal (10), wherein said tank (6) is coupled in a sealed manner on said receiving pedestal (10) and said appliance includes a venting circuit for conducting air to the level of the outlet orifice (52) of the tank, said venting circuit having one end (91) in communication with air outside of said electrical household appliance which is elevated relative to the outlet orifice (52) of the tank wherein said venting circuit comprises a local buffer zone (92) at the level of which the passage cross section is enlarged, and wherein the volume of said buffer zone (92) is greater than the volume of liquid in the supply circuit and in the steam generator (7) under normal operating conditions of the appliance.

* * * * *